US006749424B1

(12) United States Patent
Kahler

(10) Patent No.: US 6,749,424 B1
(45) Date of Patent: Jun. 15, 2004

(54) GAS BURNER IGNITION SYSTEMS

(75) Inventor: Andrew W. Kahler, Fortson, GA (US)

(73) Assignee: W. C. Bradley Company, Columbus, GA (US)

( * ) Notice: Subject to any disclaimer, the term of this patent is extended or adjusted under 35 U.S.C. 154(b) by 0 days.

(21) Appl. No.: 10/417,730

(22) Filed: Apr. 17, 2003

(51) Int. Cl.[7] ..... F23Q 7/06
(52) U.S. Cl. ..... 431/263; 126/41 R
(58) Field of Search ..... 431/263, 264; 126/41 R

(56) References Cited

U.S. PATENT DOCUMENTS

| | | | | |
|---|---|---|---|---|
| 3,449,638 A | * | 6/1969 | Beesch | 313/118 |
| 4,266,930 A | | 5/1981 | Leonard et al. | |
| 4,288,210 A | | 9/1981 | Leonard et al. | |
| 4,302,181 A | | 11/1981 | Schlosser | |
| 4,381,758 A | | 5/1983 | Svekis et al. | |
| 4,861,264 A | | 8/1989 | Romanak et al. | |
| 4,941,817 A | | 7/1990 | Schlosser | |
| 4,943,232 A | | 7/1990 | Lin | |
| 5,213,075 A | | 5/1993 | Stephen et al. | |
| 5,358,400 A | * | 10/1994 | Ejiri et al. | 431/1 |
| 5,364,264 A | | 11/1994 | Kwiatek | |
| 5,525,771 A | | 6/1996 | Lund | |
| 5,798,601 A | | 8/1998 | Hansen | |
| 5,836,756 A | | 11/1998 | Moss | |
| 5,854,530 A | | 12/1998 | LaForest et al. | |
| 5,960,783 A | | 10/1999 | Schubert et al. | |
| 6,046,528 A | | 4/2000 | LaForest et al. | |
| 6,126,435 A | | 10/2000 | Fredin-Garcia et al. | |
| 6,133,554 A | | 10/2000 | Clifford | |
| 6,146,132 A | | 11/2000 | Harneit | |
| 6,250,913 B1 | | 6/2001 | Maton | |
| 6,351,060 B1 | | 2/2002 | Harneit | |

* cited by examiner

*Primary Examiner*—Alfred Basichas
(74) *Attorney, Agent, or Firm*—James W. Kayden; Thomas, Kayden, Horstemeyer & Risley, LLP

(57) ABSTRACT

A collector box for a gas burner ignition system is disclosed, the collector box including a top half; a bottom half; an aperture disposed within the bottom half, the aperture being configured to receive an insulated electrode substantially within the center of the aperture and to allow gas from a gas burner to exit the aperture around the insulated electrode; and a grounding electrode protruding from an edge of the third aperture, where a spark may be produced between the insulated electrode and the grounding electrode. Also disclosed are gas burner ignition systems that include the above-described collector box, as well as a spark generator and an insulated electrode. The gas burner ignition system may be used in, for example, cooking devices such as barbecue grills.

20 Claims, 3 Drawing Sheets

GAS BURNER IGNITION SYSTEMS

TECHNICAL FIELD

The present invention is generally related to gas burners and, more particularly, is related to apparatuses and methods for igniting gas burners.

BACKGROUND OF THE INVENTION

Many cooking and other devices employ burners that use combustible gas as the source of heat energy for the cooking of food products. In these devices, efforts have been made to simplify the igniting of the gas burners. For example, ignition mechanisms have been designed which eliminate the need for manual ignition using matches or butane lighters. Typically, these prior art ignition mechanisms employ a spark generator, or a source of high voltage, that is connected to a single electrode is grounded through a metal frame or support in the device. The arc then ignites the gas emanating from the burner.

Although the prior art ignition mechanisms have generally worked well, the design of these mechanisms leaves them susceptible to failure in certain circumstances. For example, the electrode, or the wire connecting the electrode to the spark generator, can be inadvertently shorted to ground, thus preventing a spark from being generated between the electrode and the burner. Such a short can be caused by a variety of reasons, such as the excessive dripping and buildup of foodstuffs on the ignition mechanism. In such circumstances a potentially dangerous buildup of unignited gas could result. Additionally, corrosion may occur at assembly points in the appliance, thus shorting the ground and reducing the opportunity for an efficacious spark.

Alternative ignition mechanisms include an insulated electrode that is housed in a collector box. Gas from the burner flows into the collector box and out an opening in a side wall of the collector box. Typically the insulated electrode is the same size as the opening through which it protrudes, completely filling the opening. A dimple or protrusion stamped on a side wall of the collector box acts as a grounding electrode. Thus, the spark from the insulated electrode must be large enough to jump into the stream of gas from the burner toward the grounding electrode. If the spark generated is not large enough, is weak, or if it is not in contact with a proper concentration of gas, then the gas, and consequently the burner, do not ignite.

In addition, the collector box may be mounted to a grill casting instead of a burner, or may be screwed onto the burner via various fastening means. The attachment of the collector box to the grill parts may be problematic in that traditional fastening means tend to be cumbersome, and make the ignition system difficult to assemble. The attachments have generally not been universal in nature, with different fastening means required for attachment of the collector box to different grill parts, thus decreasing their usefulness. Because the traditional means of attaching the collector box to the grill or burner is cumbersome, there is an increased risk of erroneously assembling the collector box.

Thus, a heretofore unaddressed need exists in the industry to address the aforementioned deficiencies and inadequacies.

BRIEF DESCRIPTION OF THE DRAWINGS

The disclosed ignition system can be better understood with reference to the following drawings. The components in the drawings are not necessarily to scale, emphasis instead being placed upon clearly illustrating the principles of the ignition system. Moreover, in the drawings, like reference numerals designate corresponding parts throughout the several views.

SUMMARY OF THE INVENTION

Figure 1:
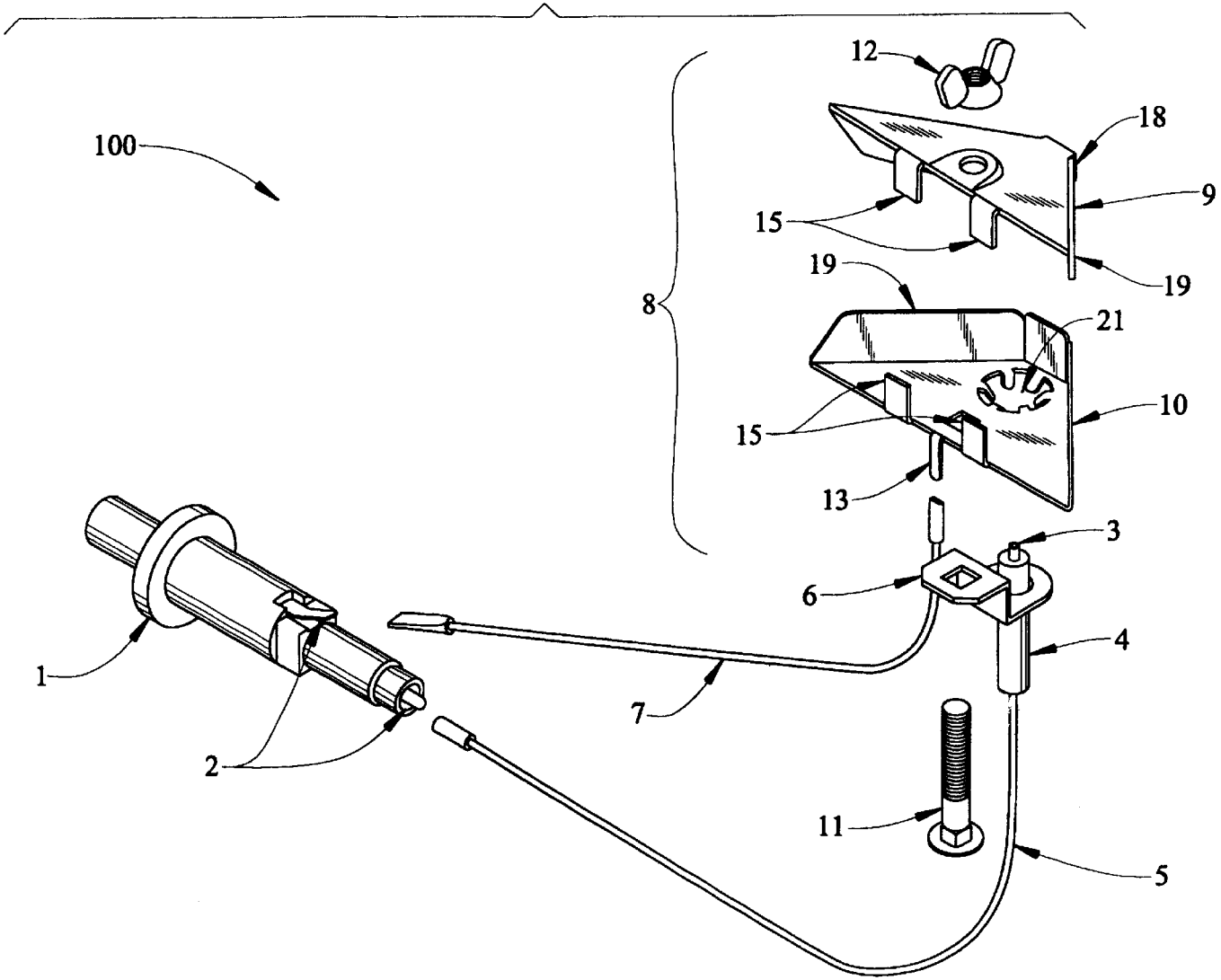
FIG. 1 is an exploded perspective view of an embodiment of the disclosed gas burner ignition system.

The disclosed gas burner ignition system includes a spark generator, the spark generator including a first electrical terminal connected to an insulated electrode via an electrically conductive lead, and a second electrical terminal connected to a ground; an insulated electrode connected to the spark generator via a wire lead; and a collector box. The collector box includes, in an exemplary embodiment, an aperture disposed within the bottom half, the aperture being configured to receive the insulated electrode substantially within the center of the aperture and to allow gas from a gas burner to exit the aperture around the insulated electrode.

The disclosed gas burner ignition system may be incorporated into a cooking device such as a barbecue grill. In such an exemplary embodiment of a barbecue grill, the grill includes a cooking surface, a source of liquid propane gas, a gas burner, and the gas burner ignition system.

DETAILED DESCRIPTION

One way to improve the ignition ability of a gas burner ignition system is to position an insulated electrode in a collector box directly in the path through which gas must flow from a burner. Additionally, placing a grounding electrode also in the path of the gas also helps ensure that the spark from the insulated electrode to the grounding electrode will ignite the stream of gas in the disclosed gas burner ignition system. In this regard, reference is now made to the figures. More specifically, referring now to FIG. 1, a representative gas burner ignition system 100 will be described in greater detail that solves deficiencies in prior art ignition systems.

The ignition system 100 includes a spark generator 1, an insulated electrode 3, and a collector box 8. The spark generator 1 has two electrical terminals 2, one for an insulated wire lead 5 for the insulated electrode 3, and one for a ground wire 7. It should be noted that while reference is made throughout the specification to an "insulated electrode 3" and "insulated wire lead 5" that leads to the insulated electrode 3, that the ground wire 7 may, in some embodiments, be insulated as well. For instance, it may be particularly desirable to insulate the ground wire 7 when using the ignition system 100 to ignite more than one burner, e.g., a side burner.

The insulated electrode 3 includes a ceramic insulator 4, and a mounting bracket 6 attached thereto. The end of the ground wire 7 is, in one embodiment, a standard electrical terminal, such as that having a shape of an elongated "C."

The collector box 8 includes a top half 9, a bottom half 10, a first fastening device 11 and an optional second fastening device 12, thereby forming an enclosure. The first fastening device 11 may be for example, a carriage bolt, or any other fastening device capable of attaching the mounting bracket 6 to the collector box 8. The second fastening device 12 may be any device that helps secure the mounting bracket 6 to the collector box 8, for example, a wing nut as shown. Both the top half 9 and the bottom half 10 of the collector box 8 include mounting flanges 15 and side walls 19. In one embodiment, flanges 15 may be, for example, but are not limited to, approximately one-fourth (¼) to approximately three-eighths (⅜) inch wide. Bottom half 10 of the collector box 8 further includes a tab 13 disposed, for example as shown in FIG. 2, between two flanges 15 that is, in a preferred embodiment, but not limited to, approximately three-thirty-secondths (3/32) to approximately one-eight (⅛) inch wide.

The ignition system 100 may be assembled in the following manner. The ground wire 7 is attached to the tab 13 on the bottom half 10 of the collector box 8. In an exemplary embodiment, the tab 13 is thin enough to be bent back manually by a user. By way of example, the tab 13 may be made of twenty-gauge stainless steel, and formed out of the same piece of metal as the bottom half 10 of the collector box 8.

The electrode 3 is then assembled to the bottom half 10 of the collector box 8 using the fastening device 11. The tab 13 is bent over the end of the fastening device 11 to aid in retaining the fastening device 11, and to aid in retaining the electrode 7 to the bottom half 10 of the collector box 8. The tab 13 may be bent over an end of the fastening device 11 at, for example, a 30-degree angle.

Figure 2:
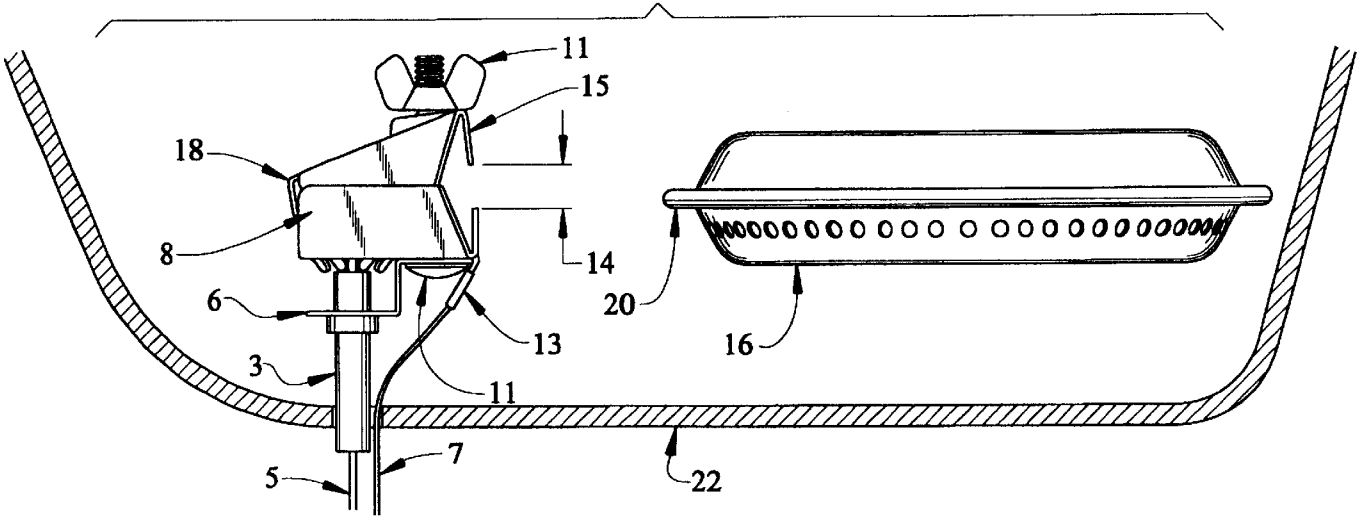
FIG. 2 is a partial exploded cross-sectional view of an embodiment the gas burner ignition system of FIG. 1 in a barbecue grill casting environment, showing the burner before mating with the collector box.

Shown in FIG. 2 is an exemplary gas burner ignition system 100 in an exemplary environment of a barbecue grill casting 22, before mating of the burner 16 with the collector box 8. As depicted in FIG. 2, the top half 9 of the collector box 8 is placed on the bottom half 10 of the collector box 8 and secured. The top half 9 and the bottom half 10 are secured together either before or after mating the collector box 8 with the burner 16. The top half 9 and the bottom half 10 can be arranged to move pivotally with respect to each other, for example, by hinges. Alternatively, the top half 9 and the bottom half 10 may be secured together by threadedly fastening the second fastening device 12 to the first fastening device 11, such as, for example, with a screw and wing nut as shown.

The side walls 19 of the top half 9 may be disposed within the side walls 19 of the bottom half 10 when the top half 9 and the bottom half 10 are connected. The top half 9 of the collector box 8 may include an optional pivoting connection 18 that aids in alignment of the top half 9 and the bottom half 10. Thus, in one embodiment, the top half 9 and the bottom half 10 form a clamshell-type design such that the fastening device 11 helps secure the top half 9 and the bottom half 10 in place. In this manner, when the second fastening device 12 is tightened, a gap 14 is decreased between mounting flanges 15 of the top half 9 and the bottom half 10. Conversely, when the second fastening device 12 is loosened over the first fastening device 11, the gap 14 increases. In this manner, the gap 14 is adjusted such that a hem, or lip, 20 of a burner 16 may slide in between flanges 15, mating the collector box 8 and the burner 16.

Figure 3:
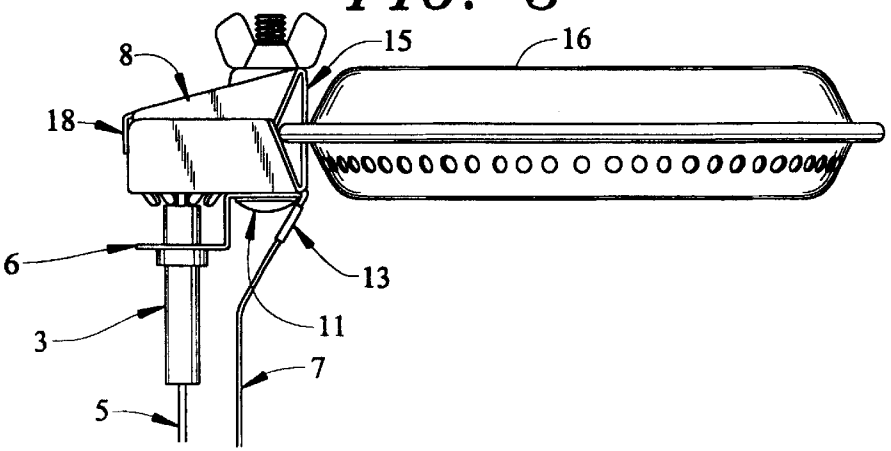
FIG. 3 is a partial cross-sectional view of the gas burner ignition system of FIG. 2, showing the assembled burner and collector box.

As shown in FIG. 3, when the hem 20 of the burner 16 is disposed between flanges 15 of the top half 9 and the bottom half 10, the flanges 15 are tightened until the flanges 15 clamp down and secure burner 16, for example, by tightening the second fastening device 12.

If the gas burner 16 is disposed in a cooking device, the insulated wire lead 5 and the ground wire 7 may also be placed in the cooking device. For instance, in a cooking device such as a barbecue grill (not shown), the wire lead 5 and the ground wire 7 are passed through the grill bottom casting 22 and through a spark generator mounting hole in a control panel of the cooking device. The insulated wire lead 5 of the electrode 3 is attached to the electrical terminal 2 of the spark generator 1. The ground wire 7 is attached to a second electrical terminal 2 of a spark generator 1. The spark generator 1 is then attached to the control panel of the cooking device. It should be noted that although the insulated wire lead 5 typically is attached to the very end of the spark generator 1, as shown in FIG. 1, it does not matter which wire 5 or 7 is attached to either of the terminals 2 of the spark generator 1. Additionally, the spark generator 1 is not limited to the exact configuration depicted in FIG. 1, but may be, for example, an electronic spark generator.

Figure 4:
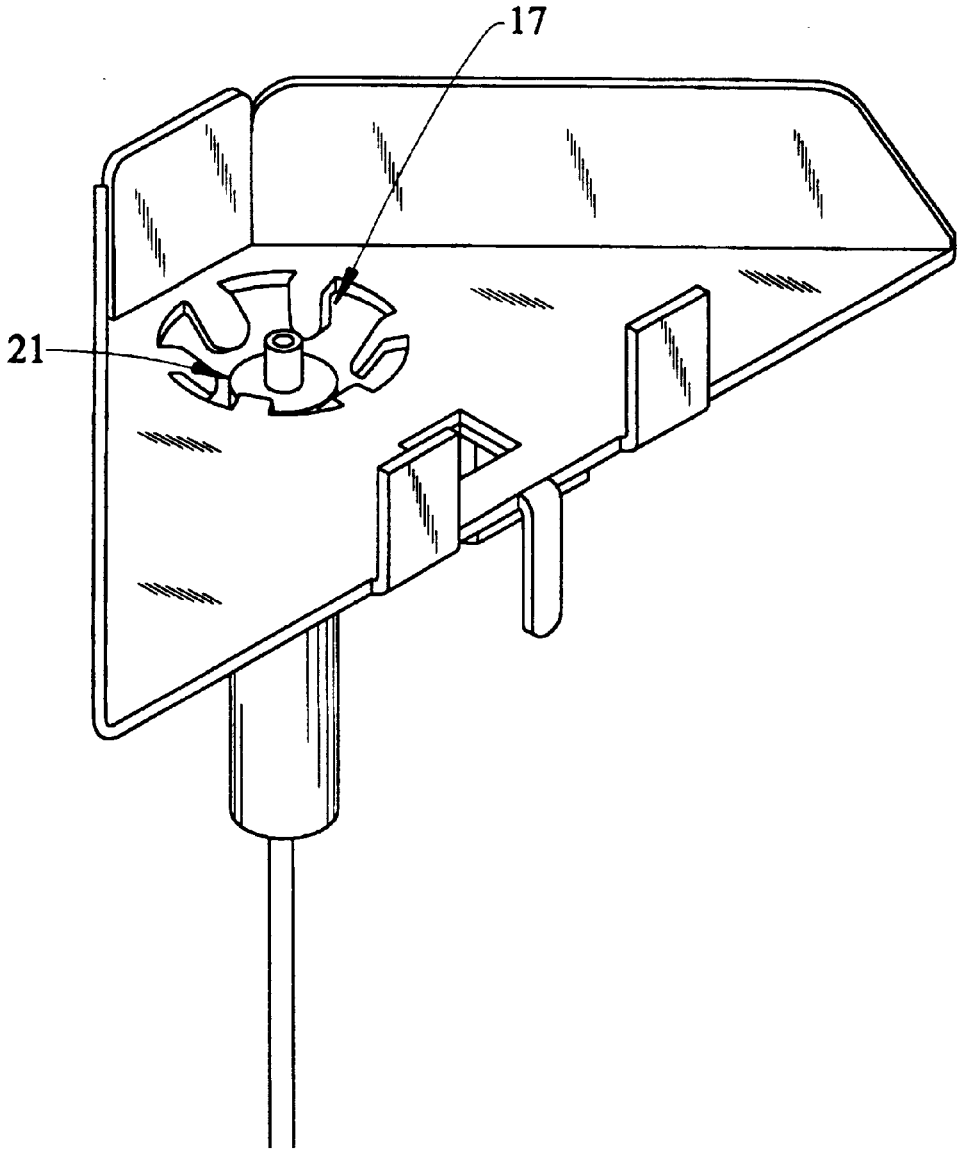
FIG. 4 is a perspective view of the bottom half of a collector box and an insulated electrode of the gas burner ignition system of FIG. 1.

The disclosed ignition system works in the following manner. Gas from the burner 16 flows into the collector box 8 and out an aperture 21 (depicted in FIGS. 1 and 4) in the bottom half 10 of the collector box 8. The aperture 21 may be circular in shape, for example. Optionally, at least one grounding electrode 17 protrudes from an edge of the aperture 21. The insulated electrode 3 is positioned substantially in the center of the aperture 21. The aperture 21 is configured to be larger in size than the insulated electrode 3 disposed therein, thus allowing gas to exit the aperture 21 around the electrode 3. Upon triggering the spark generator 1, a spark is produced between the insulated electrode 3 and either the edge of the aperture 21, or optionally, one of the grounding electrodes 17. The grounding electrode 17 is positioned so that gas exiting the collector box 8 through the aperture 21 will pass between the insulated electrode 3 and the grounding electrode 17.

The grounding electrode 17 may be bent up relative to the bottom half 10, bent down relative to the bottom half 10, and substantially planar with a bottom surface of the bottom half 10. Optionally, as shown more clearly in FIG. 4, the grounding electrode 17 may be bent in a twisted fashion like a fan blade in order to swirl the gas as it exits the collector box 8 through the aperture 21, creating a vortex-type formation with the gas. The vortex created by the swirling motion will tend to concentrate the gas around the center of the aperture 21. Additionally, the vortex-type formation serves to swirl the gas with air in the environment, causing a more efficient burning of the spark. Because the insulated electrode 3 is located in the aperture 21, more reliable gas ignitions result.

As noted with respect to FIGS. 2 and 3, the gas burner ignition system may be used in a barbecue grill. A cross-section of the grill casting 22 is depicted in FIG. 2. The grill may also include, in addition to the gas burner ignition system, a cooking surface, a source of liquid propane gas, and a gas burner. The disclosed grill is user-friendly in that the gas burner lights more efficiently and consistently than has been heretofore accomplished in the art.

It should be emphasized that the above-described embodiments of the disclosed gas burner ignition systems are merely possible examples of implementations, and are merely set forth for a clear understanding of the described principles. Many variations and modifications may be made to the above-described embodiment(s) without departing substantially from the spirit and principles of this disclosure. All such modifications and variations are intended to be included herein within the scope of this disclosure and the following claims.

What is claimed is:

1. A collector box for a gas burner ignition system, comprising:

an enclosure for collecting gas introduced therein, said enclosure including a bottom surface;

an aperture disposed within said bottom surface, the aperture including a plurality of fan-shaped grounding electrodes; and an insulated electrode substantially centrally positioned within the aperture.

2. The collector box of claim 1, wherein the aperture, the insulated electrode, and the grounding electrodes are arranged such that gas exiting the collector box through the opening will pass between the insulated electrode and the grounding electrode.

3. The collector box of claim 1, wherein the grounding electrodes each have a configuration of at least one of the following: bent up relative to the bottom surface, bent down relative to the bottom surface, and substantially planar with said bottom surface.

4. The collector box of claim 1, wherein the fan-shaped grounding electrodes are configured in a twisted fashion whereby gas exiting the collector box is swirled, creating a vortex-type formation with the gas.

5. A collector box for a gas burner ignition system, comprising:

a top half;

a bottom half connected to the top half in an arrangement whereby the top half and bottom half move pivotally with respect to each other;

an aperture disposed within the bottom half, the aperture including a plurality of striking points, wherein the striking points are configured to induce swirling of a gas with air; and an insulated electrode positioned substantially within the aperture.

6. The collector box of claim 5, wherein the aperture, the insulated electrode, and the striking points are arranged such that gas exiting the collector box through the opening will pass between the insulated electrode and the striking points.

7. The collector box of claim 5, wherein the striking points have a configuration of at least one of the following: bent up relative to the bottom half, bent down relative to the bottom half, and substantially planar with a bottom surface of the bottom half.

8. The collector box of claim 5, wherein the striking points are configured to create a vortex-type formation with the gas.

9. A collector box for a gas burner ignition system, comprising:

a top half;

a bottom half connected to the top half in an arrangement whereby the top half and bottom half move pivotally with respect to each other;

an aperture disposed within the bottom half, wherein the aperture is configured to receive an insulated electrode substantially within a center portion of the aperture and to allow gas from a gas burner to exit the aperture around the insulated electrode; and a grounding electrode protruding from an edge of the aperture, whereby a spark may be produced between the insulated electrode and the grounding electrode.

10. The collector box of claim 9, wherein the aperture, the insulated electrode, and the grounding electrode are arranged such that gas exiting the collector box through the opening will pass between the insulated electrode and the grounding electrode.

11. The collector box of claim 9, wherein the grounding electrode has a configuration of at least one of the following: bent up relative to the bottom half, bent down relative to the bottom half, and substantially planar with a bottom surface of the bottom half.

12. The collector box of claim 9, wherein the grounding electrode is configured in a twisted fashion whereby gas exiting the collector box is swirled, creating a vortex-type formation with the gas.

13. A gas burner ignition system, comprising:

a spark generator;

an insulated electrode connected to the spark generator via a wire lead; and a collector box, the collector box including a top half, a bottom half connected to the top half in an arrangement wherein the top half and bottom half move pivotally with respect to each other, an aperture disposed within the bottom half, wherein the aperture is configured to receive an insulated electrode substantially within a center portion of the aperture and to allow gas from a gas burner to exit the aperture around the insulated electrode; and a grounding electrode protruding from an edge of the aperture.

14. The gas burner ignition system of claim 13, whereby the gas burner ignition system is configured such that a spark from the spark generator may be produced between the insulated electrode and the grounding electrode.

15. The gas burner ignition system of claim 13, wherein the grounding electrode has a configuration of at least one of the following: bent up relative to the bottom half, bent down relative to the bottom half, and substantially planar with a bottom surface of the bottom half.

16. The gas burner ignition system of claim 13, wherein the grounding electrode is configured in a twisted fashion whereby gas exiting the collector box is swirled, creating a vortex-type formation with the gas.

17. A barbecue grill, comprising:

a cooking surface;

a source of liquid propane gas;

a gas burner; and a gas burner ignition system, the gas burner ignition system including a spark generator;

an insulated electrode connected to the spark generator via a wire lead; and a collector box including a top half, a bottom half connected to the top half in an arrangement wherein the top half and bottom half move pivotally with respect to each other, an aperture disposed within the bottom half, wherein the aperture is configured to receive an insulated electrode substantially within a center portion of the aperture and to allow gas from a gas burner to exit the aperture around the insulated electrode, and a grounding electrode protruding from an edge of the aperture.

18. The barbecue grill of claim 17, whereby the barbecue grill is configured such that a spark from the spark generator may be produced between the insulated electrode and the grounding electrode.

19. The barbecue grill of claim 17, wherein the grounding electrode has a configuration of at least one of the following: relative to the bottom half, bent down relative to the bottom half, and substantially planar with a bottom surface of the bottom half.

20. The barbecue grill of claim 17, wherein the grounding electrode is configured in a twisted fashion whereby gas exiting the collector box is swirled, creating a vortex-type formation with the gas.

* * * * *